US005855190A

United States Patent [19]

Matsunaga

[11] Patent Number: 5,855,190

[45] Date of Patent: Jan. 5, 1999

[54] VALVE-ACTUATING VARIABLE CAM FOR ENGINE

[75] Inventor: Nobuhiko Matsunaga, Iwata, Japan

[73] Assignee: Yamaha Hatsudoki Kabushiki Kaisha, Japan

[21] Appl. No.: 937,109

[22] Filed: Sep. 24, 1997

[30] Foreign Application Priority Data

Sep. 24, 1996 [JP] Japan ..... 8-251127
Oct. 23, 1996 [JP] Japan ..... 8-280539

[51] Int. Cl.[6] ..... F01L 13/00

[52] U.S. Cl. ..... 123/90.17; 123/90.6; 74/568 R

[58] Field of Search ..... 123/90.15, 90.17, 123/90.31, 90.6; 74/567, 568 R; 251/251

[56] References Cited

U.S. PATENT DOCUMENTS

| | | | |
|---|---|---|---|
| 4,886,022 | 12/1989 | Nakai | 123/90.17 |
| 5,184,581 | 2/1993 | Aoyama et al. | 123/90.31 |
| 5,402,759 | 4/1995 | Ding et al. | 123/90.17 |
| 5,404,770 | 4/1995 | Kruger | 74/568 R |
| 5,505,168 | 4/1996 | Nagai et al. | 123/90.17 |

FOREIGN PATENT DOCUMENTS

| | | | |
|---|---|---|---|
| 594104 | 4/1994 | European Pat. Off. | 123/90.17 |
| 3720947 A1 | 1/1988 | Germany . | |
| 3705128 A1 | 9/1988 | Germany . | |
| 167405 | 7/1989 | Japan | 123/90.6 |
| 6-307216 | 11/1994 | Japan | 123/90.6 |

*Primary Examiner*—Weilun Lo
*Attorney, Agent, or Firm*—Knobbe, Martens, Olson & Bear, LLP.

[57] ABSTRACT

A valve-actuating variable cam for a reciprocating machine is disclosed. The cam comprises a camshaft journalled for rotation by said machine and driven in timed relationship with said machine, a first cam fixed upon said camshaft and rotatable with the camshaft, and a second cam fixed for rotation with the camshaft and moveable relative to the first said cam in a direction radial to the axis of rotation of the camshaft. A shift rod is slidably mounted within the cam shaft, the shift rod having a drive surface thereon driving a key element. The key element is at least partially positioned within and engages at least the second cam. The shift rod is moveable between a first position in which the first cam engages a valve or similar element, and second position in which the key pushes the second cam radially outwardly and the valve engages the second cam.

12 Claims, 20 Drawing Sheets

Large Spring Force
Small Spring Force
Large Spring Force
Large Spring Force
Small Spring Force
Large Spring Force
46b
48b
52b
56b
58b
51b
54b
90b (a)

(b)

(a)

(b)

VALVE-ACTUATING VARIABLE CAM FOR ENGINE

FIELD OF THE INVENTION

This invention relates to an engine valve operating system and more particularly to an improved mechanism for changing the degree of lift of a valve in a reciprocating machine such as an engine.

BACKGROUND OF THE INVENTION

In many types of reciprocating machines and particularly internal combustion engines, there may be time when it is desirable to change the valve operating characteristics during the running of the engine. Conventional variable valve timing mechanisms (VVT) have been proposed for varying the timing of opening and closing of the valves in an engine. By providing such variable valve timing it is possible to obtain improved engine performance over a wider range of engine speed and load conditions.

In addition to changing the valve timing events, there is also a desire to provide a mechanism that will change the lift of the valve. By changing the lift of the valve, the induction and/or exhaust efficiency of the engine can be changed during running to offer further enhancements in engine performance. Although the changing of the timing of the opening and closing of the valves utilizing a VVT mechanism is relatively easy to accomplish, the changing of the lift of the valve is more difficult to accomplish.

Because of the difficulty in changing the lift of the valve during the actual running of the engine, very complicated mechanisms have employed. Generally, one type of these mechanisms include follower devices that are interposed between the actuating camshaft and the valve and which change the degree of lift by changing the mechanical advantage between the cam and the actuated valve. Obviously, these systems become quite complicated. Furthermore, they frequently add to the reciprocating mass of the engine and can thus, deteriorate to some extent the engine performance.

In some instances, the variable lift is provided by substituting for the conventional type of cam and follower arrangement, an actual driving system which drives the valve without necessitating the use of a camshaft. These mechanisms become even more complicated than the variable follower mechanisms.

It is, therefore, a principal object of this invention to provide a variable lift valve-actuating mechanism for a reciprocating machine that easily permits the lift to be changed without significantly adding to the complexity of the actuating mechanism.

It is a further object of this invention to provide an improved camshaft arrangement for providing variable lift for the valve of a reciprocating machine.

It is a still further object of this invention to provide an improved engine camshaft for achieving variable valve lift in a relatively simple and inexpensive manner.

SUMMARY OF THE INVENTION

In accordance with the present invention, a variable cam is provided for actuating valves of an engine.

The variable cam includes a camshaft journalled for rotation by said machine and driven in timed relationship with the machine. A first or low speed/low load cam is fixed upon the camshaft and rotatable with the camshaft. Likewise, a second or high speed/high load cam is fixed for rotation with said camshaft and moveable relative to the first said cam in a direction radial to the axis of rotation of the camshaft.

A shift rod is slidably mounted within the cam shaft, said shift rod having a drive surface thereon driving a key element, the key element positioned within and engaging at least the second cam. Means are provided for moving said shift rod to a first position in which the first cam engages the valve, and second position in which the key pushes the second cam radially outwardly and the valve engages the second cam.

Preferably, spring means are provided for biasing the shift rod into its first position. In one embodiment, fluid pressure acts upon the shift rod to move it between its first and second positions. In other embodiments, an actuator moves the shift rod.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In accordance with the present invention, there is provided a valve lift mechanism for a machine, such as an engine. The lift arrangement in accordance with the present invention is arranged to be variable, that is, to change the amount of valve lift under one or more conditions or circumstances. Preferably, this lift arrangement is accomplished with a variable cam.

Figure 1:
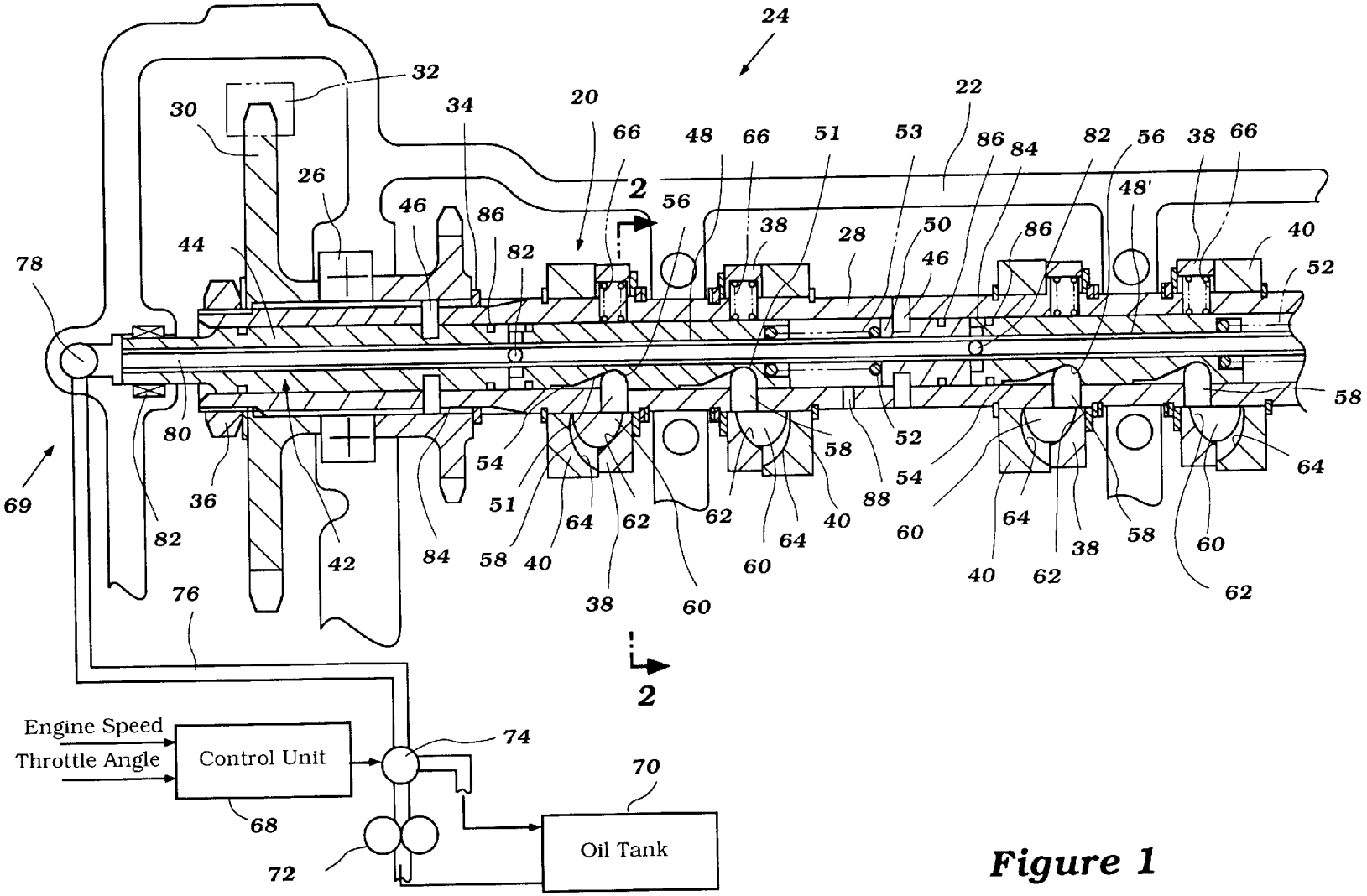
FIG. 1 is partial cross-sectional view taken through a portion of a cylinder head of an internal combustion engine having a variable cam constructed in accordance with a first embodiment of the present invention, with portions of an actuating mechanism and drive for the cam illustrated schematically.
Figure 2:
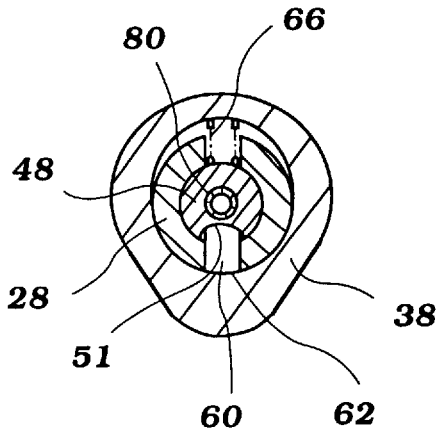
FIG. 2 is a cross-sectional view of the variable cam illustrated in FIG. 1 taken along line 2—2 therein.

A first embodiment variable cam 20 in accordance with the present invention is illustrated in FIG. 1. As the cam 20 arrangement of the present invention is particularly useful in actuating valves of an internal combustion, this is the particular environment in which the cam 20 is described. Of course, the cam 20 may be suited to other uses.

In this environment, the cam 20 is rotatably supported by a portion of a cylinder head 22 of an engine 24. Preferably, the cam 20 is supported by one or more bearings 26, indicated in phantom.

The cam 20 includes a cam shaft 28. The cam shaft 28 is an elongate hollow cylinder. The cam shaft 28 is rotatably driven. As illustrated, a cam drive gear 30 is mounted at one end of the cam shaft 28. The gear 30 is arranged to be drive off of a crankshaft (not shown) of the engine 24, such as by a drive chain 32. The gear 30 is held in place on the cam shaft 28 by a key 34 along the shaft 28, and a nut 36 positioned near its end. Preferably, the drive system for the cam shaft 28 is arranged so that the cam shaft 28 rotates at one half of the speed of the crankshaft of the engine, as is well known to those skilled in the art in four-cycle engine technology.

A number of cam elements are movably mounted on the cam shaft 28. Preferably, a high speed/high load cam 38 and a low speed/low load cam 40 are provided corresponding to each valve which is to be actuated. Though not shown in this figure, a tappet member is preferably provided corresponding to each valve, each pair of cams 38, 40 arranged to engage one tappet, and thus move one valve.

Each cam 38, 40 is connected to the cam shaft 28 in a manner whereby they rotate with the cam shaft 28. The high speed cams 40, however, are also mounted so that they may move radially with respect to the cam shaft 28.

The high and low speed cams 38, 40 are mounted directly adjacent to one another in pairs. Preferably, these cams 38, 40 have a similar overall outer profile. The low speed cam 40 is preferably wider (in a direction parallel to the length of the cam shaft 28) than its corresponding high speed cam 38. The pairs of high and low speed cams 38, 40 may be retained in place along the cam shaft 28 by keys, pins or other means known in the art.

When the engine 24 is operating at a low speed or in a low load condition, the variable cam 20 of the present invention is arranged so that the low speed/low load cams 40 engage the tappets, actuating the valves. On the other hand, when the engine 24 is operating at a high speed or in a high load condition, the variable cam 20 is arranged so that the high speed/high load cams 38 engage the tappets, actuating the valves.

As illustrated, this arrangement is accomplished by providing means for moving each high speed cam 38 between a first position in which it does not extend radially as far out as its corresponding low speed cam 40, whereby the tappet only engages the low speed cam 40, and a second position in which at least a portion of the high speed cam 38 extends radially farther out than the low speed cam 38, whereby the tappet engages, at least during a portion of the time, the high speed cam 40 and is actuated thereby.

This actuating system or means 42 preferably comprises an oil-pressure activated shift rod 48. The shift rod 48 is positioned within the cam shaft 28. A stop element 44 extends from the driven end of the cam shaft 28 for journalled support by the cylinder head 22 into the interior of the cam shaft 28. This stop 44 is securely connected to the cam shaft 28 by a locking pin 46, such that rotation of the cam shaft 28 effects rotation of the stop element 44, and prevents its lateral movement along the length of the cam shaft 28.

A shift rod 48 is movably positioned adjacent the innermost end of the stop element 44. As illustrated, the shift rod 48 has a length sufficient to extend along that portion of the cam shaft 28 from a first set of high and low speed cams 38, 40 to a second set of high and low speed cams 38', 40'.

An intermediate stop 50 is spaced from the shift rod 48 and is separated therefrom with a spring 52 spanning an empty chamber 53 within the cam shaft 28. This stop 50, as with the first 44, is locked to the cam shaft 28 with a key or pin 46.

Another shift rod 48' extends through that portion of the cam shaft 28 on which are mounted the next two pairs of high and low speed cams 38, 40. The sequence of a space, another stop element, and so on continues itself along the length of the variable cam 20, dependent upon the number of cams.

Each shift rod 48 includes a driving surface 51 which has a first portion 54 slightly radially depressed from an outer surface of the rod 48, a second portion 56 more greatly radially depressed or inset from the outer surface, and a ramped or sloping surface therebetween.

A shift pin 58 has a first end engaging the driving surface 51. The shift pin 58 extends through the cam shaft 28 into engagement with a key element 60. The key element 60 is positioned outside of the cam shaft 28 and within an interior space within the high and low speed cams 38, 40 by key surfaces 62, 64 thereof. The key surfaces 62, 64, along with the remainder of the high and low speed cams 38, 40 are arranged so that in an unbiased state, the key element 60 engages the key surface 62 of the high speed cam 38 but not the low speed cam 40.

Preferably, a spring 66 is positioned in a void within the high speed cam 38, the spring having a first end engaging the cam and a second end positioned against the shift rod 42. The spring 66 is positioned opposite that portion of the high speed cam 38 in which the key 60 is mounted, thus biasing the cam 38 in a direction such that its key surface 62 engages the key 60 and the high speed cam 38 does not extend radially as far outward from the cam shaft 28 as does the low speed cam 40.

Means are provided for moving the shift rods 48. Preferably, this means comprises an oil supply system 69. As illustrated, a control unit 68 receives data such as engine speed and throttle angle for use in determining the desired operating state of the variable cam 20.

Oil or similar material is provided in reservoir 70 and pumped therefrom with a pump 72. The control unit 68 controls a valve 74 positioned along an oil delivery line 76 extending from the pump 72. The delivery line 76 extends to a supply port 78 in communication with an oil supply passage 80. The passage 80 extends centrally through the cam member 28 and the stop elements 44, 50 and shift rods 48. The passage 80 is preferably defined by a tube or similar element, and spans the open spaces or gaps 53 adjacent the shift rods 48.

An oil supply port 82 extends from the passage 80 into a chamber 84 at the end of each shift rod 48 adjacent the adjacent stop 44, 50. Oil seals 86 are provided along the stop elements 44, 50 and shift rods 48 for preventing the leakage of oil from the chambers 84.

Operation of this embodiment variable cam 20 is as follows. At a low engine speed or low load condition, the control unit 68 closes the valve 74, preventing oil from flowing therethrough. The springs 52 bias the sliding portions 48 of the shift rod 42 into the second position 56 of the driving surface 56. In this position, the key 60 is in a position close to the cam shaft 28 (with the high speed cam 38 pressed thereagainst by the action of the spring 66). The low speed cam 38 extends outwardly farther from the cam shaft 28 that than the high speed cam 40 so that only the low speed cam 38 drives the tappets or valves.

In the event a high engine speed or high engine load condition is detected by the control unit 68, the valve 74 is opened and pressurized lubricant flows from the tank 70 through the delivery line 76 and into the passage 80. This lubricant passes through the ports 82, filling the chambers 84. As the lubricant fills the chamber 84, the shift rod 48 moves laterally (to the right in FIG. 1) within the cam shaft 28. As the shift rod 48 moves right, it compresses the spring 52, and air within the chamber 53 is expelled through a relief port 88.

As the shift rod 48 moves to the right, the key 60 rides along the driving surface 51, pressing it radially outwardly until it reaches a position in which is sets in the second position 54. As the key 60 is pressed radially outwardly, it presses upon the key surface 62 of the high cam 38, thus pressing the high speed cam radially outwardly against the force generated by the spring 66. At this time, at least a portion of the high speed cam 38 extends radially outwardly of the cam shaft 28 farther than the low speed cam 40, actuating the tappet or valve.

Upon return to a low speed or low load condition, the valve 74 is moved into a position which allows the lubricant to return to the tank 70, the springs 52 biasing the shift rods 48 portions back to their low speed/low load positions.

Figure 3:
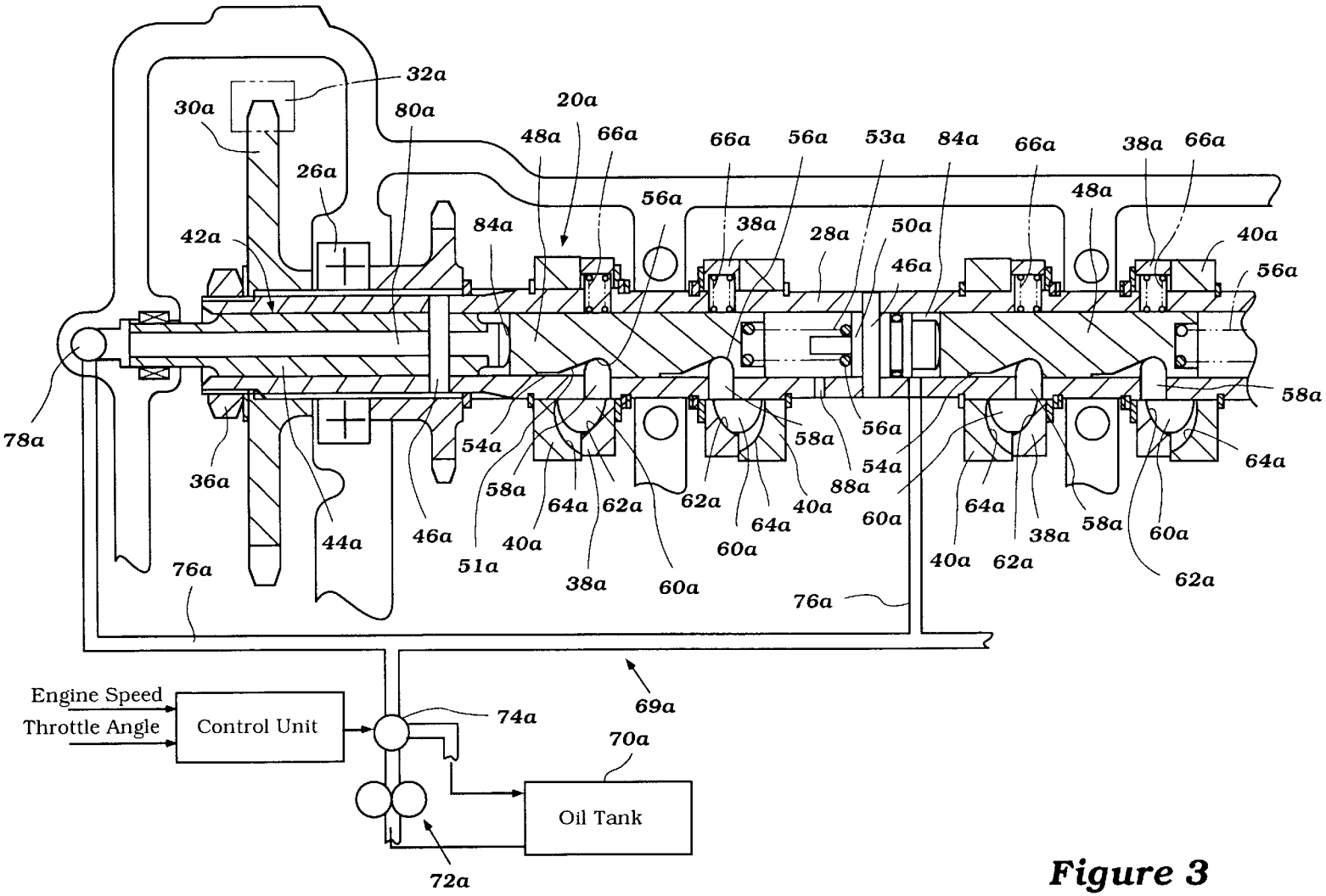
FIG. 3 is a partial cross-sectional view taken through a portion of a cylinder head of an internal combustion engine having a variable cam constructed in accordance with a second embodiment of the present invention, with portions of an actuating mechanism and drive for the cam illustrated schematically.

FIG. 3 illustrates a second embodiment variable cam 20*a* in accordance with the present invention. As this embodiment cam has many similarities to that described above, like reference numerals are used for similar parts to those used in the description and illustration of the first embodiment, except that an "a" designator has been added to all of the reference numerals of this embodiment.

This embodiment is similar to the last except for the actuating mechanism by which the shift rod 48*a* is moved. In this arrangement, oil is delivered to an oil chamber 84*a* by a separate delivery line 76*a*. Oil fills the chamber 84*a* and presses the shift rod 48*a* laterally. In this manner, the shift rods 48*a* move in a fashion similar to that described above, changing the position of the high speed cam 38*a*. This arrangement eliminates the need for a tube passing entirely through the cam shaft 28*a* for defining an single source oil delivery passage.

Figure 4:
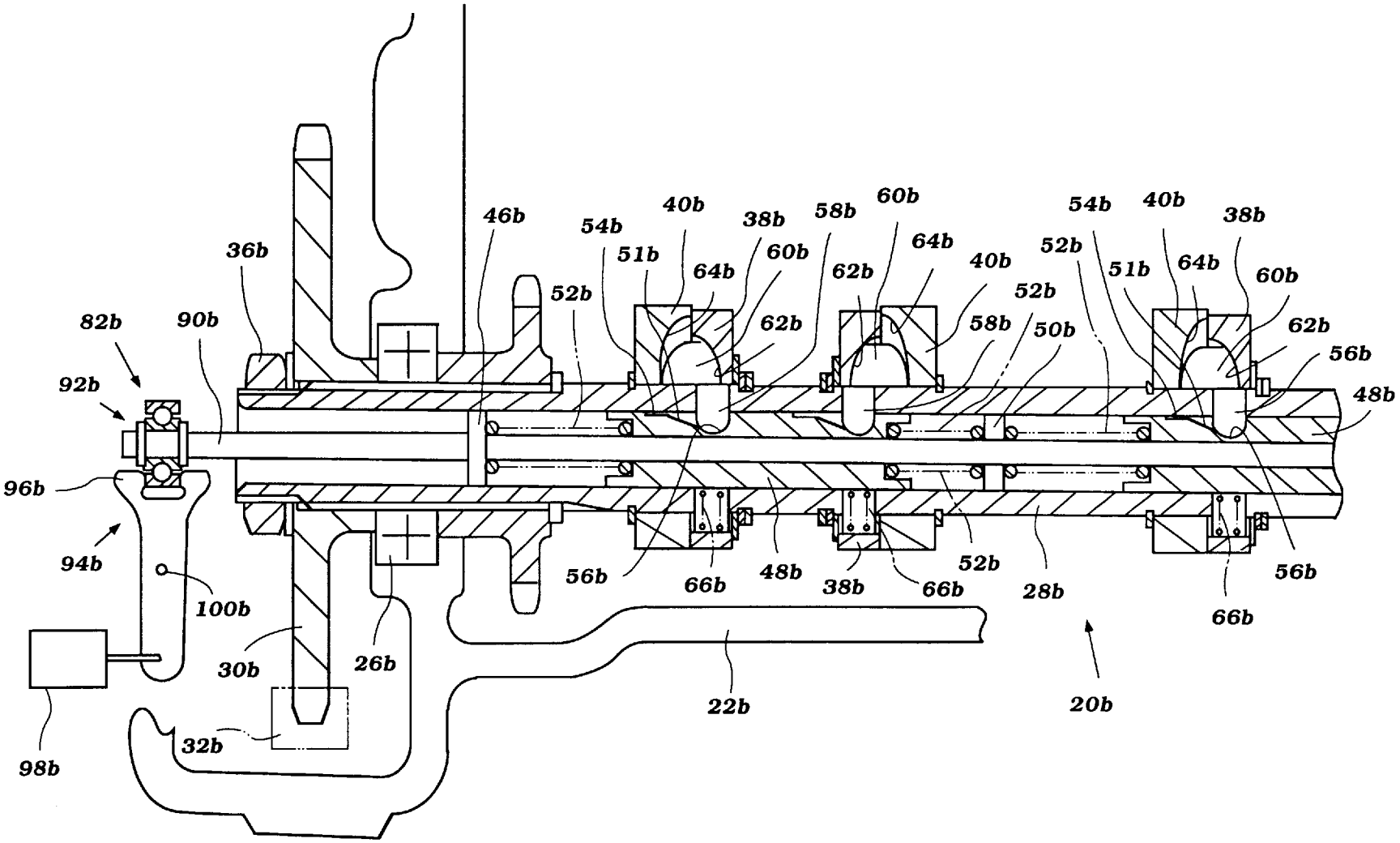
FIG. 4 is a partial cross-sectional view taken through a portion of a cylinder head of an internal combustion engine having a variable cam constructed in accordance with a third embodiment of the present invention, with portions of an actuating mechanism and drive for the cam illustrated schematically.

A third embodiment variable cam 20*b* in accordance with the present invention is illustrated in FIG. 4. As this embodiment cam has many similarities to those described above, like reference numerals are used for similar parts to those used in the description and illustration of the previous embodiments, except that a "b" designator has been added to all of the reference numerals of this embodiment.

This embodiment cam 20*b* is similar to those described above, except that a different shift rod 48*b* actuating mechanism is employed. In this embodiment a control rod 90*b* extends through the cam shaft 28*b*. The stop elements 46*b*, 50*b* are positioned on and directly connected to the control rod 90*b*. A spring 52*b* extends between the stop 46*b* and the first shift rod 48*b* and that rod 48*b* and the next stop 50*b*, and that stop 50*b* and the next shift rod 48*b*, and so on.

A first end 92*b* of the control rod 90*b* extending from the cam shaft 28*b* is journalled by bearings 82*b*. The control rod 90*b* is arranged to be moved laterally within the cam shaft 28*b*. Preferably, a first end 96*b* of an actuator 94*b* is connected to the control rod 90*b*. The second end of the actuator 94*b* is connected to an actuating device, such as an oil pressure actuator 98*b*. The actuator 94*b* is pivotally mounted about a pin 100*b*.

The oil pressure actuator 98*b* is moved in accordance with a control strategy such as that described above with respect to the oil supply system of the first embodiment illustrated in FIG. 1. The operation of the cam 20*b* will be described in conjunction with FIG. 4 and FIGS. 5(*a*)–(*d*), which illustrate the operating positions of the shift rods 48*b* via the control rod 90*b*.

Figures 5A, 5B, 5C, 5D:
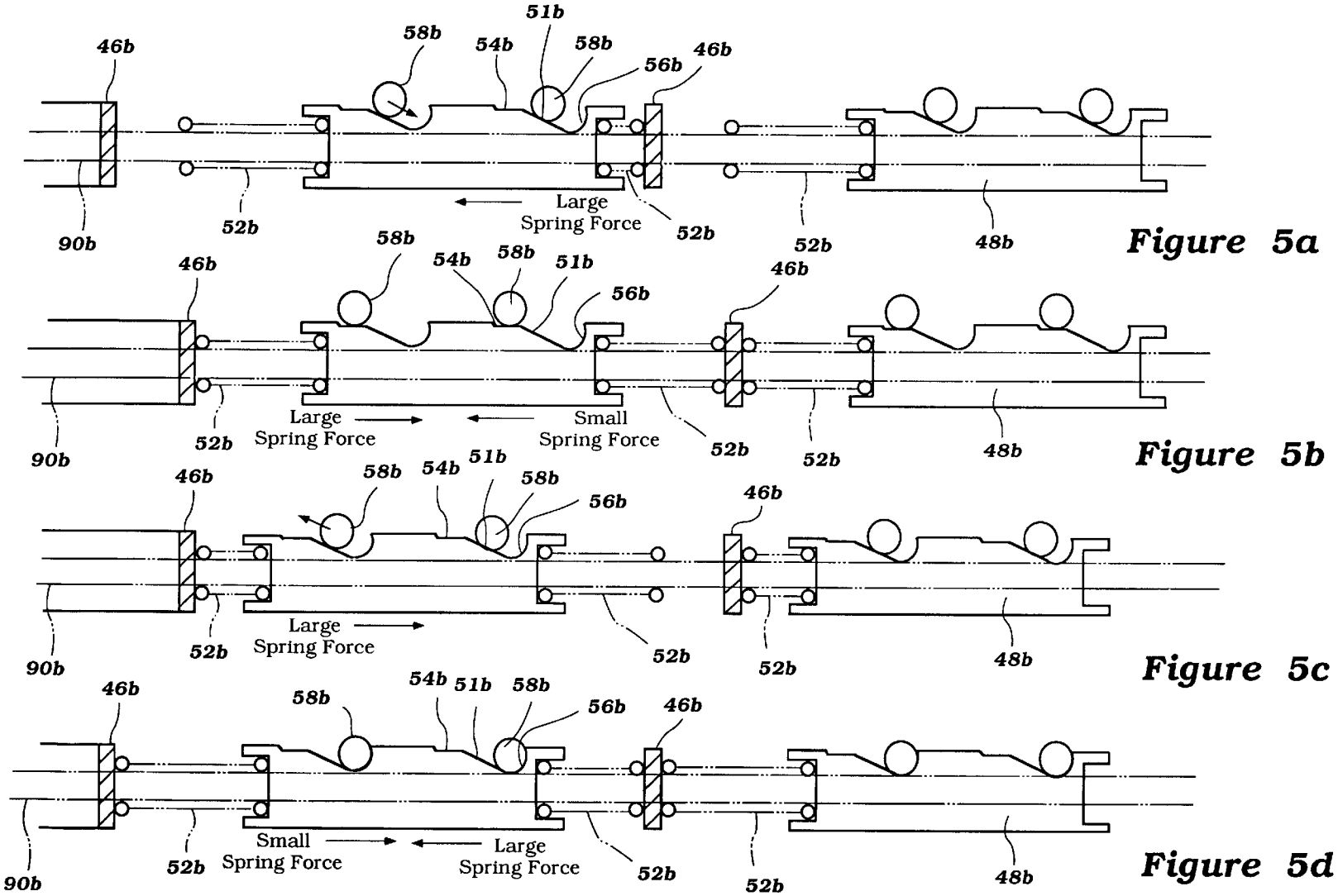
FIGS. 5*a–d* illustrate various operating positions of the variable cam illustrated in FIG. 4.

In the position illustrated in FIGS. 4 and 5(*a*), the low speed cam 40 drives the tappets or valves. Here, the spring 52*b* to the right side of each shift rod 48*b* exerts a greater force than the spring to the left, such that the shift rod 48*b* is biased into its left-most position with the shift pin 58*b* in the first position 56*b*.

In the event a high speed or high load condition arises, the oil pressure actuator 98*b* moves quickly inwardly, moving the top end 96*b* of the actuator 94*b* moving to the right, and pushing the control rod 90*b* to the right. This causes a compression of the spring 52*b* on the left side of each shift rod 48*b*, as illustrated in FIG. 5(*b*). The shift rod 48*b* is moved to the left by the left-side spring, reaching equilibrium as illustrated in FIG. 5(*c*) at a position in which the shift pin 58*b* is in the second position 54*b*. In this position, as described in greater detail above, the key 60*b* presses the high speed cam 38*b* outwardly into engagement with the tappet or valve. Upon return to a low speed or low load condition, the oil pressure actuator 98*b* moves the control rod 90*b* quickly to the left, as illustrated in FIG. 5(*d*), with the shift rod 48*b* then biased back to the left and into a position in which the low speed cam 40*b* engages the tappet or valve.

Figure 6:
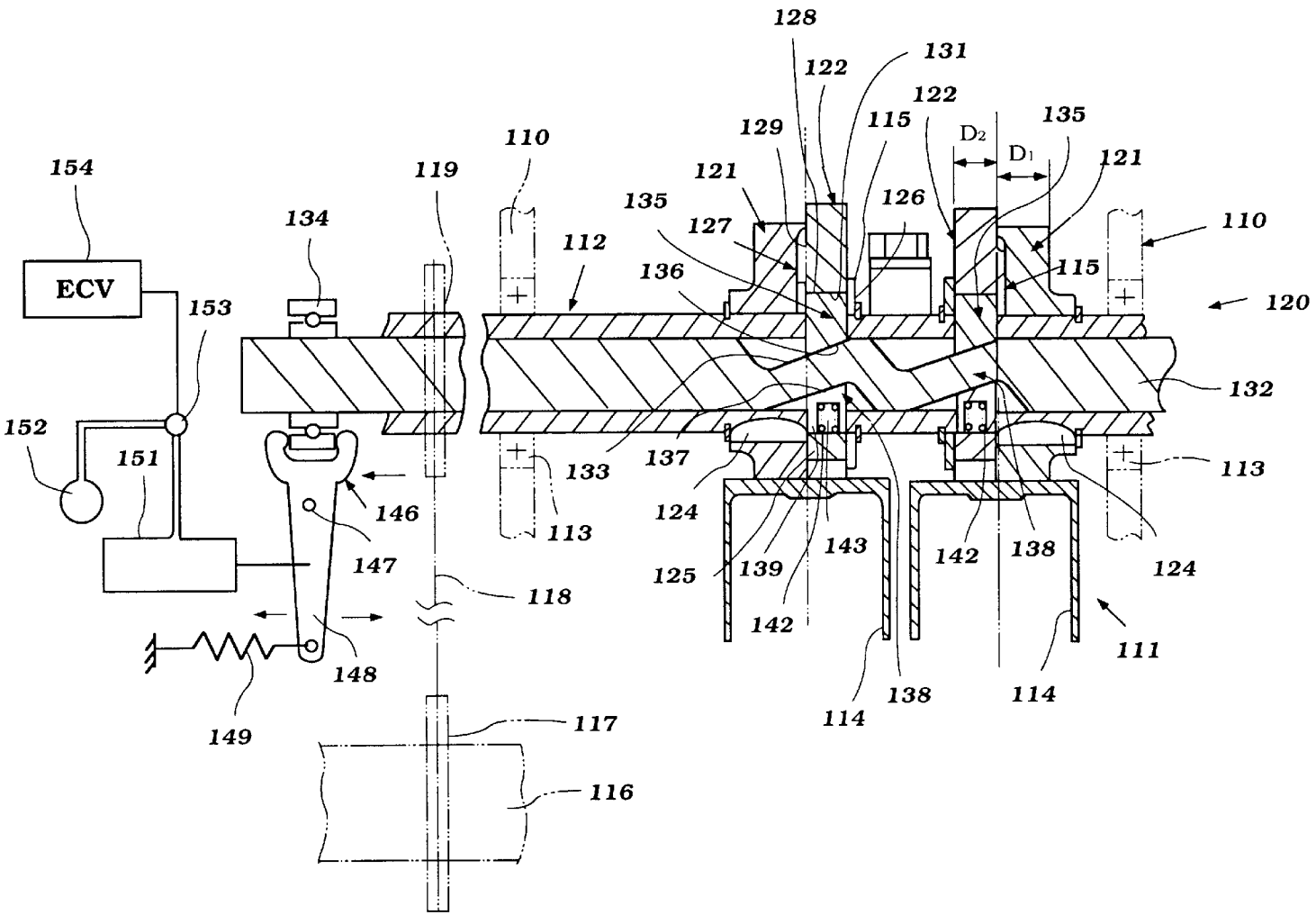
FIG. 6 is a partial cross-sectional view taken through a portion of the cylinder head of an internal combustion engine having a variable cam constructed in accordance with a fourth embodiment of the invention, with portions of the actuating mechanism as well as the drive for the cam shown schematically.
Figure 7:
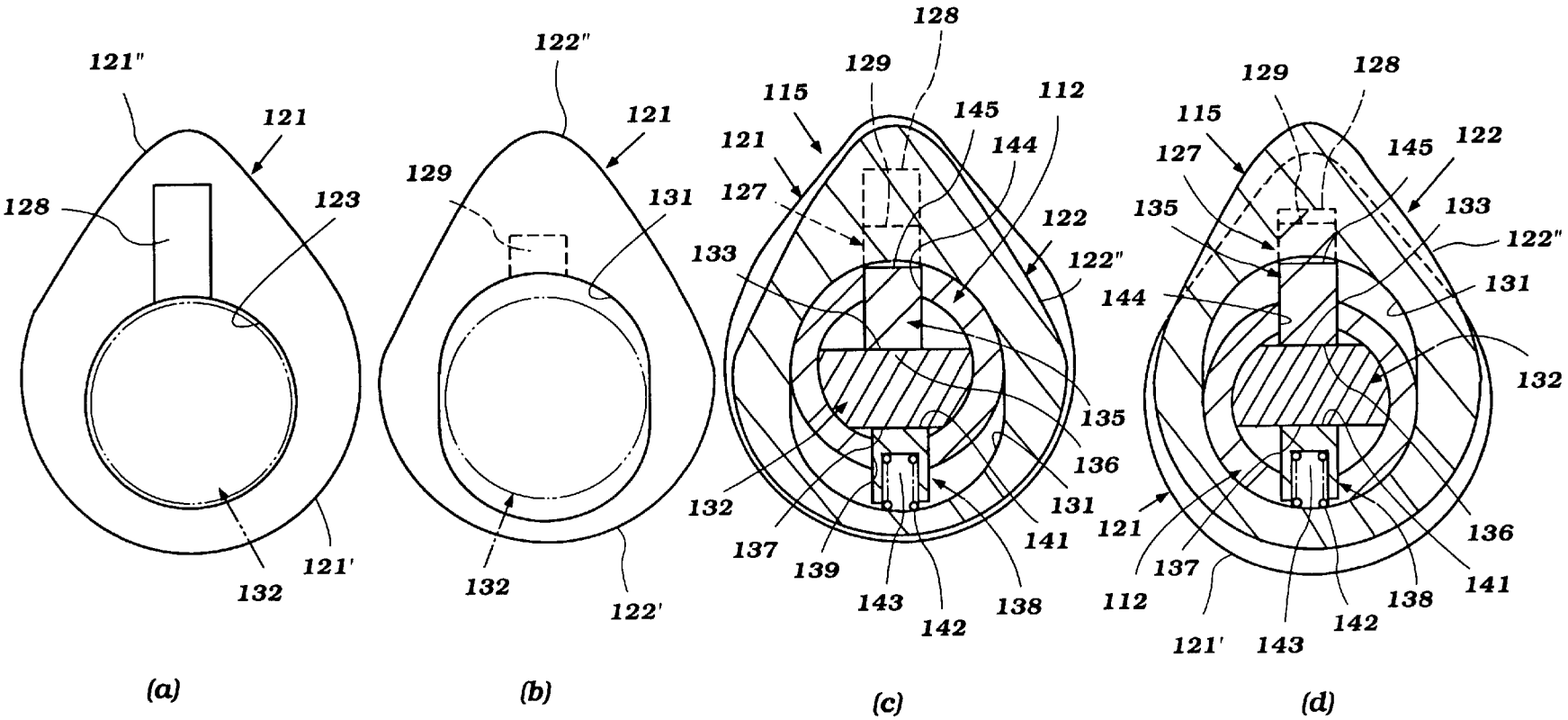
FIGS. 7*a–d* are a series of cross-sectional views taken along a plane perpendicular to the axis of rotation of the cam and showing in FIG. 7(*a*) the low speed cam, 7(*b*) the high speed cam, 7(*c*) the combined mechanism in the low speed, low load condition and in FIG. 7(*d*) the combined mechanism in the high speed, high load condition.

FIGS. 6 and 7 illustrate a fourth embodiment variable cam 120 in accordance with the present invention. In the illustration of this embodiment, a portion of the cylinder head 110 is depicted but is shown only partially. This cylinder head is formed with a cam chamber 111 in which a camshaft, indicated generally by the reference numeral 112 is journalled on longitudinally spaced bearings, indicated in phantom and identified by the reference numeral 113. The camshaft is associated with a pair of valve-actuating tappets 114 that are slidably supported in bores formed in the cylinder head and which extend into the cam chamber 111 for cooperation with cam assemblies, indicated generally by the reference numeral 115 for controlling the position of associated poppet-type valves (now shown).

As with the previous embodiments, a crankshaft 116 of the engine drives a sprocket 117 which, in turn, drives a chain 118 for driving a further sprocket 119 that is affixed to the camshaft 112 for driving it at one half (½) crankshaft speed as is well-known in the art. If desired, a variable valve timing mechanism may be included in the drive for the camshaft 112 so that not only the lift but also the timing of opening and closing of the valves can be adjusted.

Each cam mechanism 115 is comprised of a low-speed/low-load cam, indicated generally by the reference numeral 121, and a high-speed/high-load cam, indicated generally by the reference numeral 122. These respective cams 121 and 122 are shown in FIGS. 7(*a*) and (*b*). Each cam 121 and 122 is formed with a respective heel portion 121' and 122' and a lift or lobe portion 121" or 122". The cams 121 and 122 are both connected for simultaneous rotation with the camshaft 112 in a manner which will be described shortly. However, the high-speed cam is also mounted in a manner which will be described, on the tubular camshaft 112 for movement in a radial direction so as to change the effective lift of the camshaft, as will be described shortly.

Each low speed cam 121 has an inner surface 123 surrounding the camshaft 112, and is preferably keyed with a key 124 to the tubular camshaft 112 so that it rotates simultaneously with it. A retainer ring 125 holds the low-speed cam 121 axially on the camshaft 12.

The second, high-speed/high-load cam 122 is held axially on the tubular shaft 122 by means of a retainer ring 126. This retainer ring 126 also assists in causing an interlocking driving relationship, indicated generally by the reference numeral 127 to be established between the two cams 121 and 122. Hence the cam 121 drives the cam 122.

The cam 121 has a groove 128 in its face which faces the cam 122. The cam 122, in turn, has a lug 129 that is trapped in the groove 128 and which thus establishes a rotary driving connection between the two cams 121 and 122. This connection, however, permits the high speed cam 122 to move radially relative to the low speed cam 121 while maintaining the angular relationship therebetween.

As may be best seen in FIG. 7, the high speed cam 122 has an elliptical-shaped opening 131 that provides a clearance around the tubular camshaft 112 so as to permit the cam 122 to be moved from the position shown in FIG. 7(*c*) (a low speed low load and low lift position) to the position shown in FIG. 7(*d*) and in solid lines in FIG. 6. This latter position is the high lift position.

Contained within the hollow interior of the tubular camshaft 112 is a cam-actuating shaft or shift rod, indicated generally by the reference numeral 132. This cam-actuating shaft 132 is formed with a plurality of camming surfaces 133 which are generally axially aligned with the cams 122.

At one end of the camshaft assembly the cam-actuating shaft 132 extends axially beyond the tubular camshaft 112 and beyond its sprocket 119. A bearing assembly 134 is connected to this end of the cam-actuating shaft 132 and permits the cam actuating shaft 132 to rotate while being moved axially within the tubular camshaft 112. An actuating mechanism, to be described, is provided for achieving this operation.

As may be seen, there is associated with each of the cam surfaces 133 of the cam-actuating shaft 132 a follower plunger, indicated generally by the reference numeral 135. Each follower 135 has an inclined surface 136 that is engaged with the cam surface 133.

The side of the cam-actuating shaft 132 opposite to its camming surface 133 is formed with a further inclined surface 137. This inclined surface 137 is engaged by a spring-biased plunger assembly, indicated generally by the reference numeral 138. This plunger assembly is mounted in a bore 139 formed in the tubular camshaft 112 so that the plunger 138 will rotate along with the camshaft 112 as well as the cam-actuating shaft 132. The plunger 138 has a surface 141 that is engaged with the cam-actuating shaft 132 and is biased into engagement with that surface by a coil compression spring 142 contained within a hollow opening 143 in the plunger 138. The spring 143 is engaged with the elliptical opening 131 of the second or high-speed cam 122.

In a similar manner, the plunger 135 is slidably supported within a bore 144 of the tubular camshaft 112 diametrically opposed to the bore 139. This plunger 135 has a surface 145 that engages the cam opening 131.

Thus, when the cam-actuating shaft 132 is moved to the left as seen in FIG. 6 from the position shown in FIG. 7(*c*) to that position illustrated in FIG. 7(*d*), the plunger 135 will be urged upwardly and will engage the cam 122 and move it so that its lobe 122" extends radially beyond the lobe 121" of the low speed cam 121. Thus, the high speed cam 122 will effect the total amount of lift of the tappet 114 and its associated valve and will increase the actual lift even though the lift of the high speed cam 122 itself is not greater than that of the low speed cam 121. By moving the cam 122 radially outwardly in the direction of its lobe surface 22", the effective lift is increased, as should be readily apparent. Thus, it is possible to change the lift of the tappet 114 and the associated valve when the engine is running and without a complicated mechanism being interposed between the cams 121 and 122 and the tappet 114 or other valve-actuating element.

It should also be noted that the axial length D2 of the high speed cam 122 is not greater than and preferably is less than the axial length D1 of the first cam 121. As may be seen, only a small portion of the cam lobe 122" extends beyond the cam lobe 121" even in the full lift position and thus the load on this lobe is less than that on the primary or first lobe 121.

The mechanism for effecting the axial movement of the cam-actuating shaft 132 will now be described with reference to FIG. 6. This includes a yoke-like member, indicated generally by the reference numeral 146 that captures the bearing 134. The yoke member 146 is pivotally supported on a pivot pin 147 and has an actuating arm 148 which is biased by a spring 149 in the left so as to move the cam-actuating shaft 132 to the right or to the low-speed/low-load condition. Thus, if there is failure in the actuating mechanism, the mechanism will fail safe to the low-speed/low-load and low lift condition.

In order to effect movement in the high-speed/high-load high lift condition, an oil pressure actuator system comprised of the pressure cylinder 151 is provided which is actuated from an oil pressure source 152 via a solenoid control valve 153. The valve 153 is operated from an ECU 154 with any control strategy which senses either engine speed and/or engine load. When high-speed/high-load conditions prevail, the valve 153 is open so that the actuator 151 will pivot the actuating yoke 146 in the counterclockwise direction to move the cam-actuating shaft 132 to the left and cause the high speed cam 122 to be moved radially outwardly to the position shown in FIGS. 6 and 7(*d*) to achieve maximum lift of the associated poppet valve.

Figure 8:
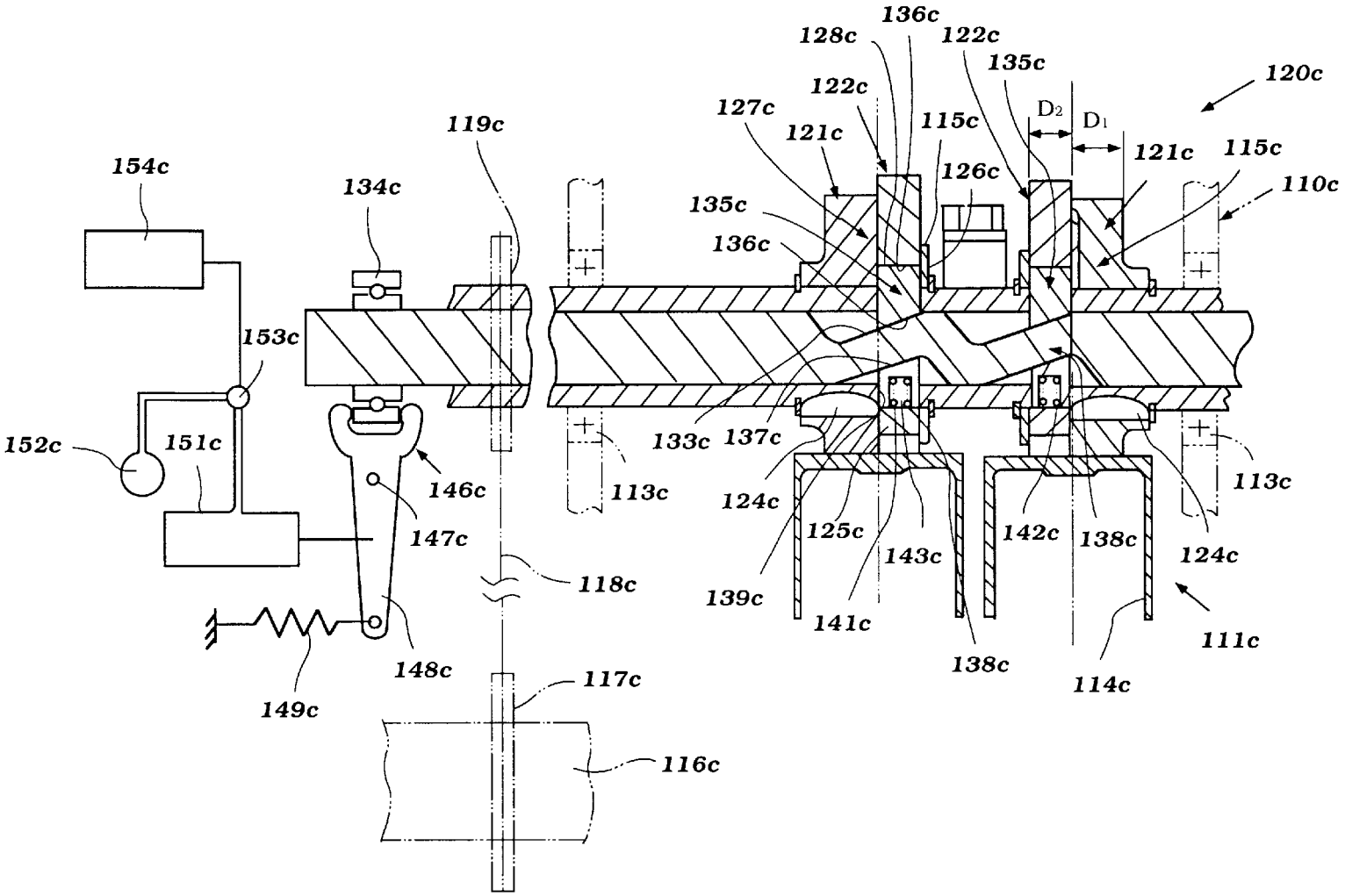
FIG. 8 is a partial cross-sectional view taken through a portion of the cylinder head of an internal combustion engine having a variable cam constructed in accordance with a fifth embodiment of the invention, with portions of the actuating mechanism as well as the drive for the cam shown schematically.
Figure 9:
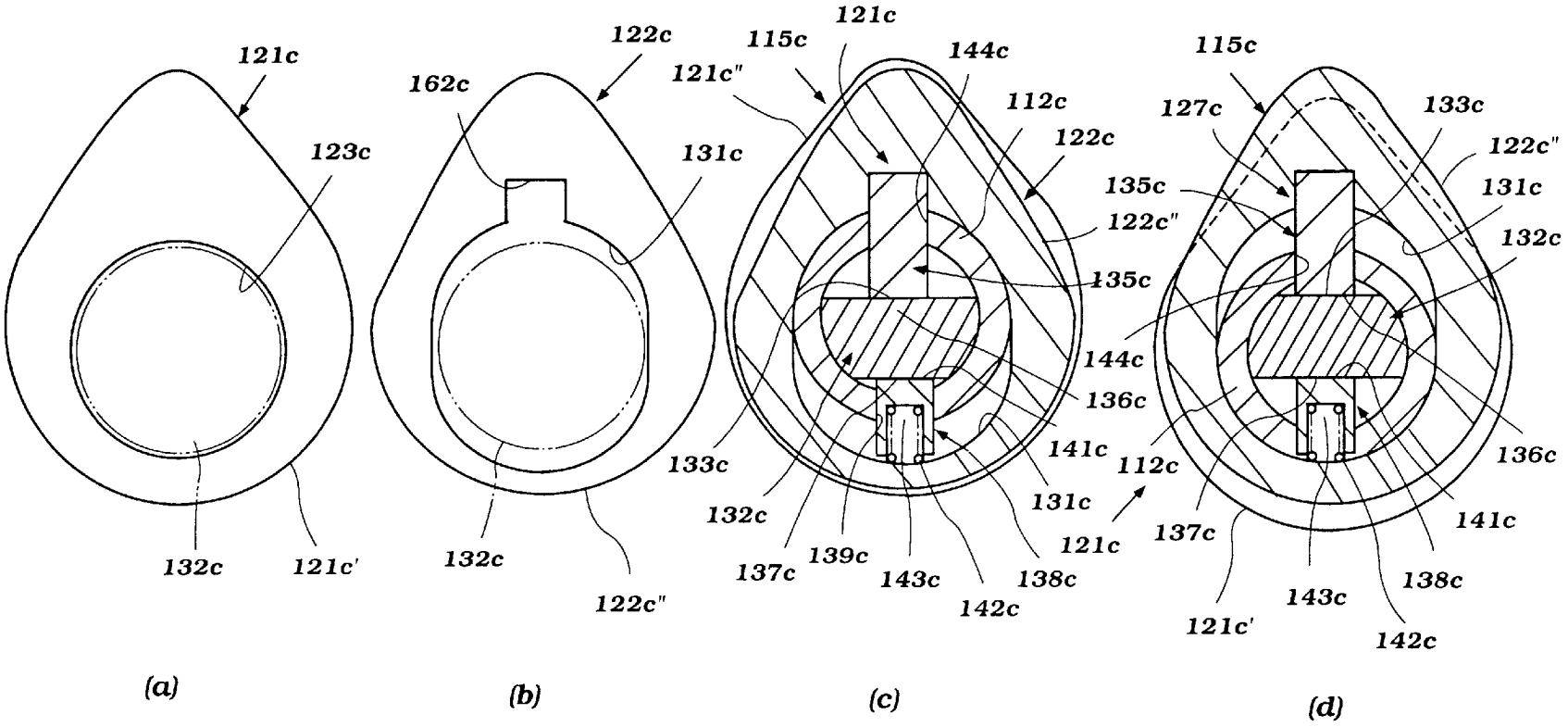
FIGS. 9*a–d* are views, in part similar to those of FIG. 7, but showing the cam mechanism of the embodiment of FIG. 8 in four views that correspond to the views of FIG. 7.

FIGS. 8 and 9(*a*)–(*d*) illustrate a sixth embodiment variable cam 120*c* of the invention which is similar to the embodiment illustrates in FIGS. 6 and 7. As this embodiment cam has many similarities to that described above and illustrated in FIG. 6 and 7, like reference numerals are used for similar parts to those used in the description and illustrations thereof, except that a "c" designator has been added to all of the reference numerals of this embodiment.

In this embodiment, no interlocking mechanism (as was present in the previous embodiment and labeled 135) between low and high speed cams 121*c* and 122*c* is used. Thus, there is no direct driving connection between the cams 121*c* and 122*c*. In this embodiment, however, the actuating plunger of the previous embodiment is extended as indicated by the new plunger 135*c* so as to be constantly engaged in a key 162*c* of the high speed cam 122*c*. Hence, even in the low-speed condition as shown in FIG. 9(*c*), the plunger 160*c* is engaged in the groove 162*c* and thus establishes a driving connection between the tubular camshaft 112*c* and the high speed cam 122*c* because of the key-like action of the plunger 160*c* and groove 162*c*. Hence, the construction can be simplified by this structure and still maintain constant rotation of both cams 121*c* and 122*c* regardless of which one is actually operating the tappet 114*c* and associated valve.

Figure 10:
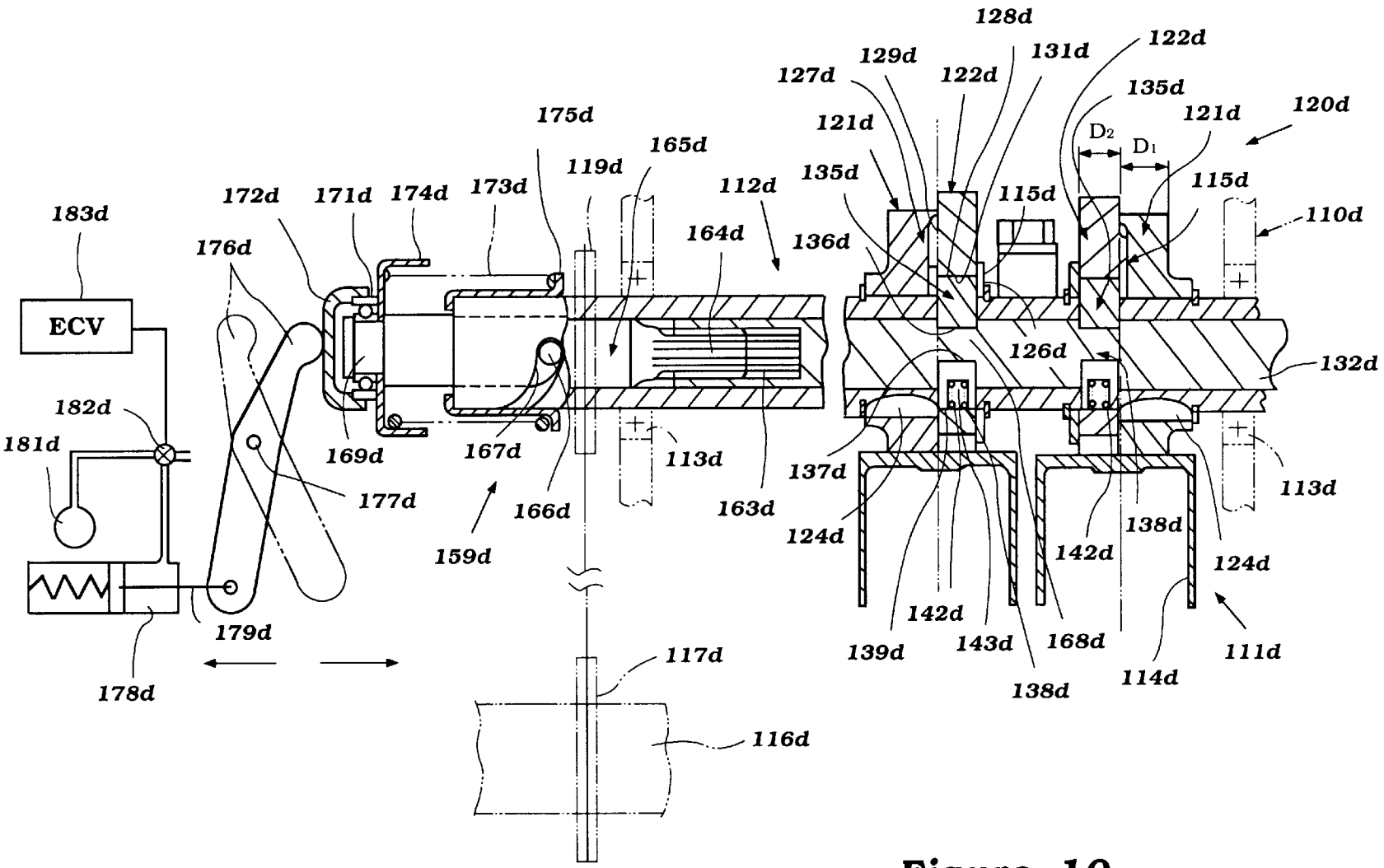
FIG. 10 is a partial cross-sectional view taken through a portion of the cylinder head of an internal combustion engine having a variable cam constructed in accordance with a sixth embodiment of the invention, with portions of the actuating mechanism as well as the drive for the cam shown schematically.
Figure 11:
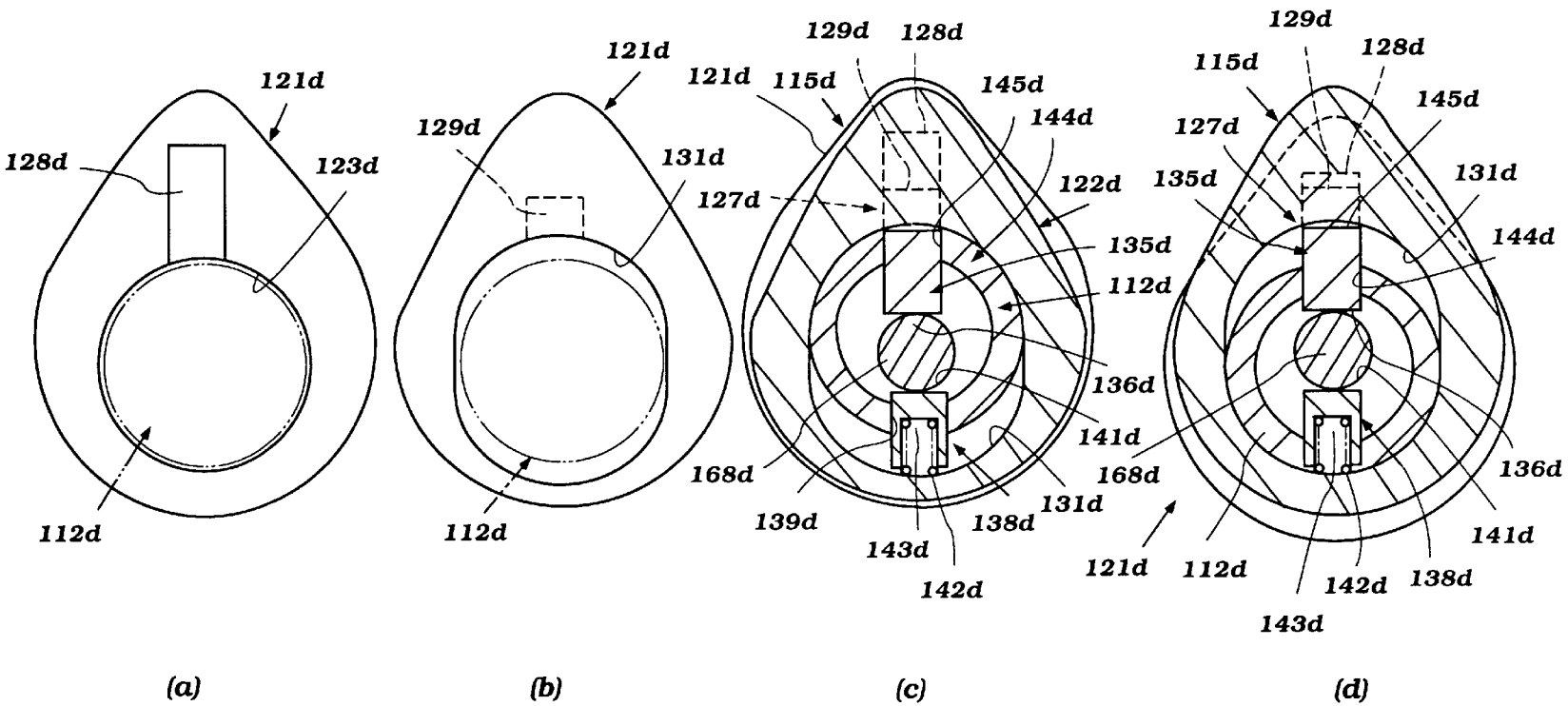
FIGS. 11*a–d* are views similar to those of FIGS. 6 and 9, but showing the cam mechanism illustrated in FIG. 10 in the same four views.

FIGS. 10 and 11(*a*)–(*d*) show a sixth embodiment variable cam 120*d* in accordance with the invention. This embodiment is basically the same as the fourth and fifth embodiments illustrated in FIGS. 6 and 8, and as such, like reference numerals are used for similar parts to those used in the description and illustrations thereof, except that a "d" designator has been added to all of the reference numerals of this embodiment.

In this embodiment, the cam-actuating shaft does not move axially in order to change or actuate the second or high-speed cam 122*d*. Rather, its phase angle is changed relative to that of the tubular camshaft 112*d*. Thus, only the actuating mechanism, indicated generally by the reference numeral 159*d* and the cam-actuating shaft, indicated by the reference numeral 132*d* differs from the previously-described embodiment.

The cam-actuating shaft 132*c* is journalled within the tubular camshaft 112*d* and is rotatable relative to it to a limited extent. To achieve this operation, the one end of the cam-actuating shaft 132*d* terminates within the tubular camshaft 112*d* and is formed with a splined opening 163*d*. A splined projection 164*d* of an actuating shaft 165*d* is received within this splined opening 163*d*.

The actuating shaft 132*d* has a pin 166*d* affixed to it which is received within a helical slot 167*d* formed in the one end of the tubular camshaft 112*d* beyond its forward-most journal and forwardly of the sprocket 119*d*. Thus, when the actuator is moved axially, it will also rotate relative to the tubular camshaft 112*d* so as to change the angular phase between the cam-actuating shaft 132*d* and the camshaft 112*d*. The mechanism for achieving this axial movement and phase rotation will be described later.

Figure 12:
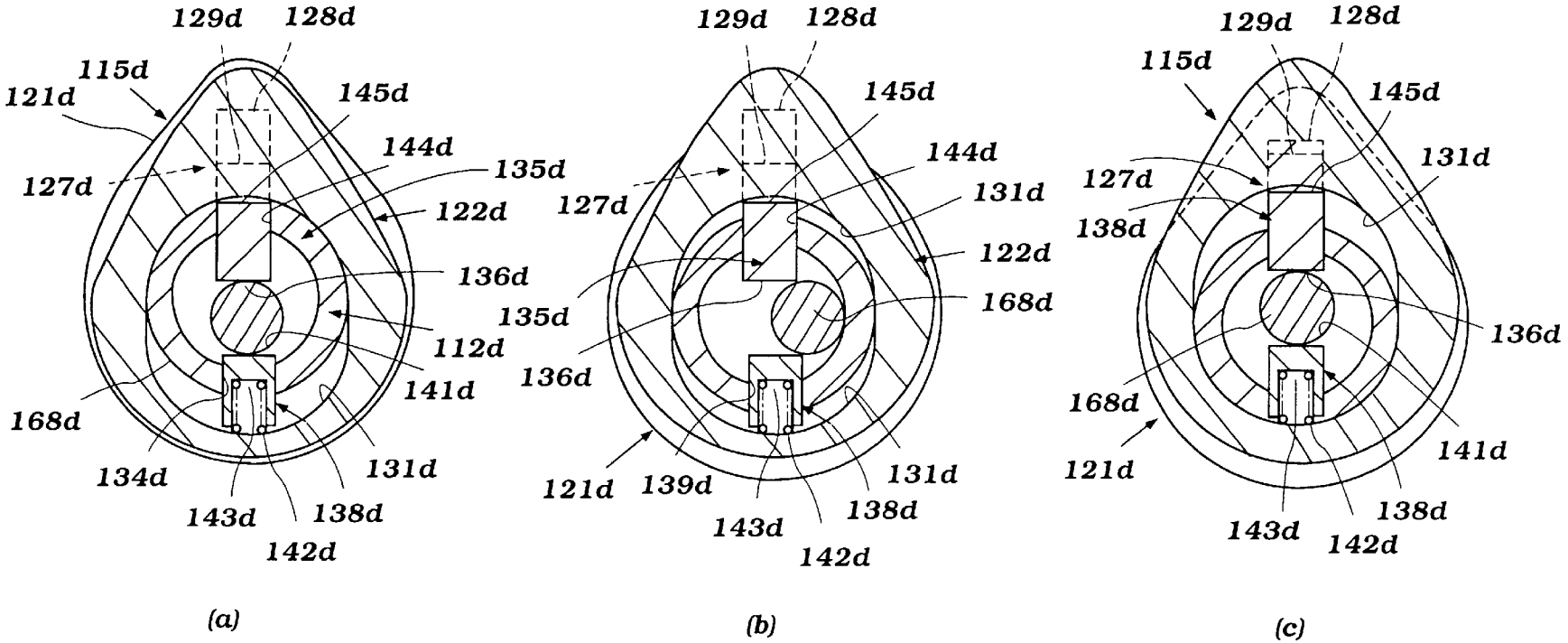
FIGS. 12*a–c* are views in part similar to FIGS. 11*c* and 11*d*, further showing a transition from a low speed, low load operation (FIG. 12(*a*)) through a transition (FIG. 12(*b*)) to a high speed, high load operation (FIG. 12(*c*))

In this embodiment, the cam-actuating shaft 132*d* is formed within cylindrical sections 168*d* which have generally the shape of the crank journals of a crankshaft. Hence, these cylindrical sections 168*d* are received between the cam-actuating plunger 135*d* and the backup plunger 138*d*. Hence, when the phase of the cam-actuating shaft 132*d* is changed relative to the tubular shaft 112*d* as shown in FIGS. 12(*a*)–(*c*), the cam-actuating shaft cylindrical portion 168*d* will move so as to extend the plunger 135*d* and cause the high speed cam 122*d* to move radially outwardly so as to change the lift of the valve. This movement can continue for 180° of relative rotation to the position shown in FIG. 12(*c*) so as to achieve maximum lift which is also shown in FIG. 11(*d*).

The mechanism for causing this rotation will now be described by reference to FIG. 10. It will be seen that the actuator 165*d* extends axially beyond the tubular camshaft 132*d* and has a portion 169*d* that is journalled in a bearing 171*d* and which is engaged by an actuating cap 172*d*. A coil compression spring 173*d* is loaded between a pair of retainers 174*d* and 175*d* that are axially fixed to the actuator 165*d* and tubular camshaft 112*d*, respectively. Hence, in the fail-safe mode the actuator 165*d* will move to the left under the action of the spring 173*d*. In this position, the phase angle between the shafts 132*d* and 112*d* is such that the cylindrical section 168*d* will be at the bottom or diametrically opposite the plunger 135*d* as shown in FIG. 12(*a*). This is, like the other embodiments, the fail-safe position for the device.

In this embodiment, an actuating lever 176*d* is pivotally supported on a pin 177*d* and has an end portion that is engaged with the cup-shaped actuator 172*d*. A hydraulic cylinder 178*d* is connected by a piston rod 179*d* to the opposite end of the actuator link 176*d*. A source of hydraulic fluid 181*d* can communicate with the cylinder 178*d* through a solenoid control valve 182*d* so as to move to the position shown in solid lines in FIG. 10 so as to rotate the phase of the shaft 162*d* relative to the shaft 112*d* to the position shown in FIG. 12(*c*) in FIGS. 10 and 11. An ECU 183*d* actuates the valve 182*d* in response to engine running conditions such as load and/or speed as previously described.

Figure 13:
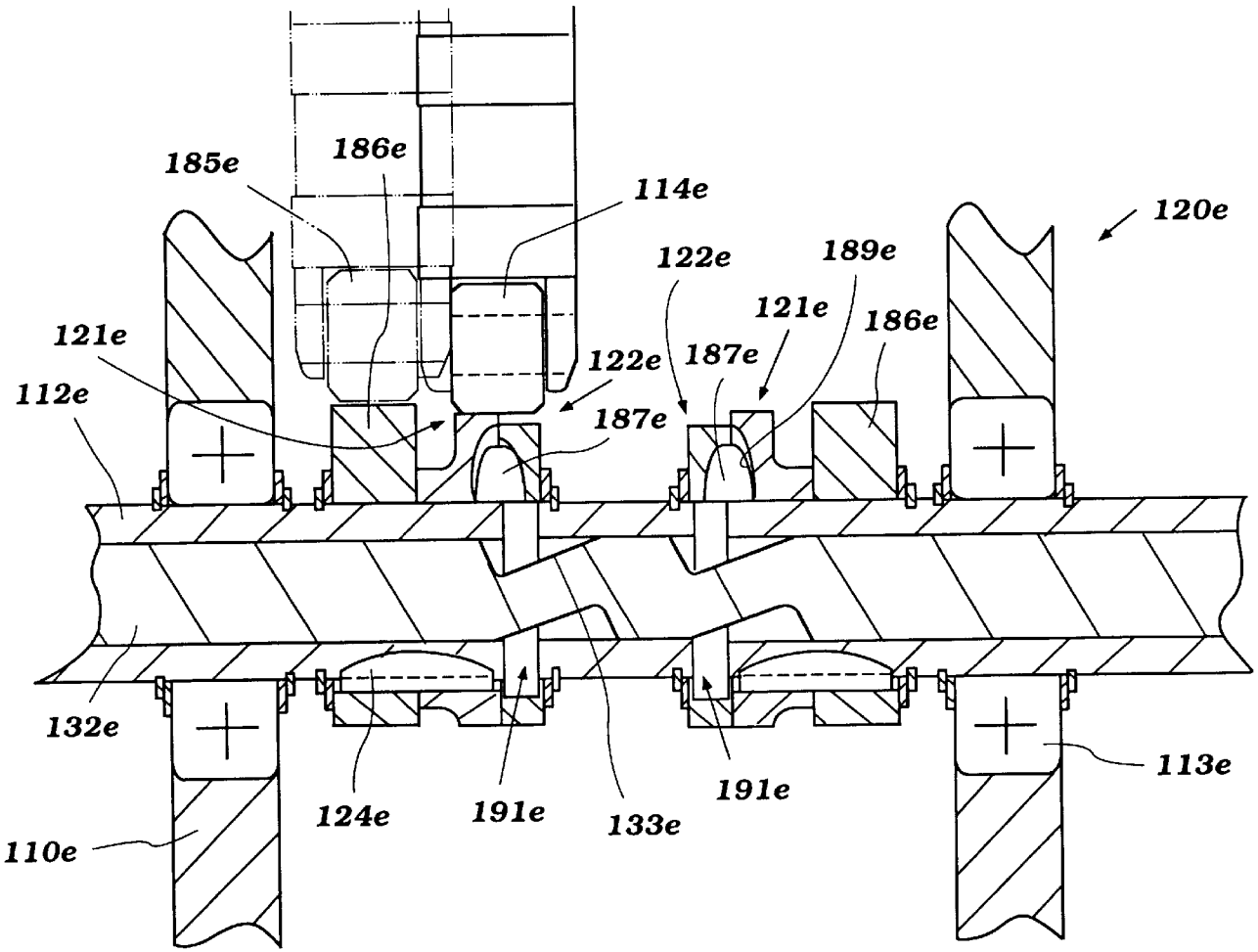
FIG. 13 is a partial cross-sectional view taken through a portion of the cylinder head of an internal combustion engine having a variable cam constructed in accordance with a seventh embodiment of the invention, with portions of the actuating mechanism as well as the drive for the cam shown schematically.

FIG. 13 illustrates a seventh embodiment variable cam 120*e* in accordance with the present invention. This embodiment cam is similar to the fourth, fifth and sixth embodiments illustrated in FIGS. 6, 8 and 10, and as such, like reference numerals are used for similar parts to those used in the description and illustrations thereof, except that an "e" designator has been added to all of the reference numerals of this embodiment.

In this embodiment, the cam 120*e* is arranged to actuate at least one intake valve 114*e* of an engine in variable lift fashion, and at least one exhaust valve 185*e* of the engine with a non-variable lift arrangement. As illustrate, an exhaust cam 186*e* is mounted on the cam 112*e* and fixed along with a low-speed/low load intake cam 121*e* to the cam 112*e* with a key 124*e*. The exhaust cam 186*e* may have any of a number of profiles as known to those skilled in the art. A high speed/high load cam 122*e* is also provided on the shaft 112*e*.

The high speed cam 122*e* is moved radially inwardly in and out with an actuating shaft 132*e* which is similar in shape to that illustrated and described in the fourth, fifth and sixth embodiments (FIGS. 6, 8 and 10). Like the first embodiment illustrated in FIG. 1, however, a shift pin 191*e* is arranged to ride along a drive surface 133*e* of the rod 132*e*. The shift pin 191*e* drives a key 187*e* which is positioned in a hollow space defined within each of the high and low speed cams 122*e*, 121*e* and defined by surfaces 193*e* and 194*e*, respectively. An outer surface 189*e* of the key 187*e* engages the high speed cam 122*d*, moving it in and out in a manner described in conjunction with the first embodiment, as the rod 132*e* moves left and right in a manner similar to that described with respect to the embodiment illustrated in FIG. 6.

Figure 14:
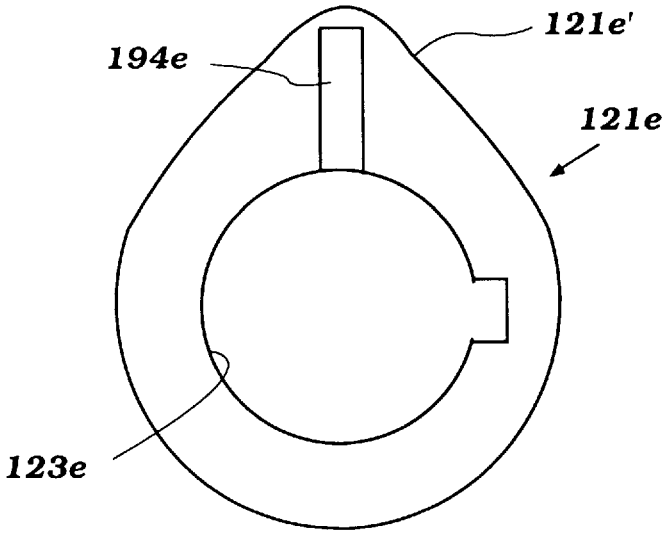
FIGS. 14*a* and *b* illustrate in front and side cross-section a low speed, low load cam of the variable cam illustrated in FIG. 13.
Figure 14:
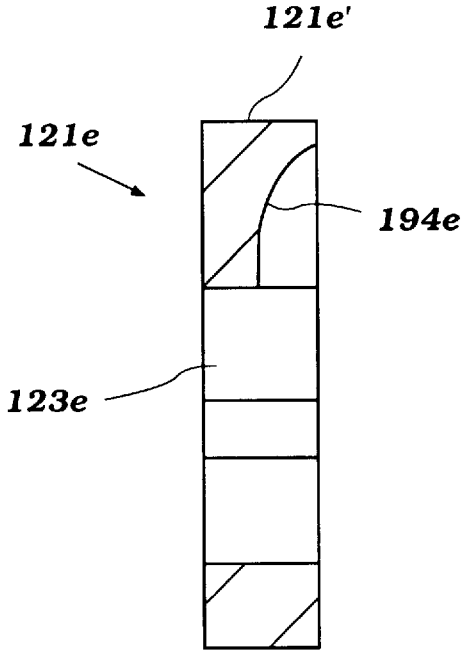
Figure 15:
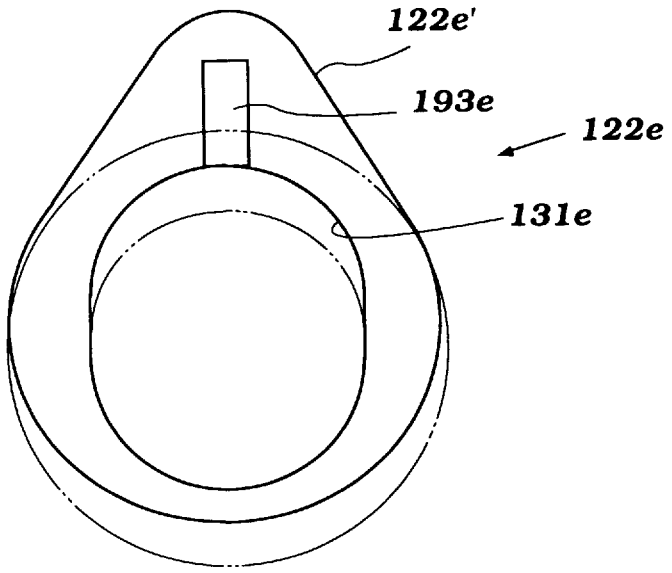
FIGS. 15*a* and *b* illustrate in front and side-cross-section a high speed, high load cam of the variable cam illustrated in FIG. 13.
Figure 15:
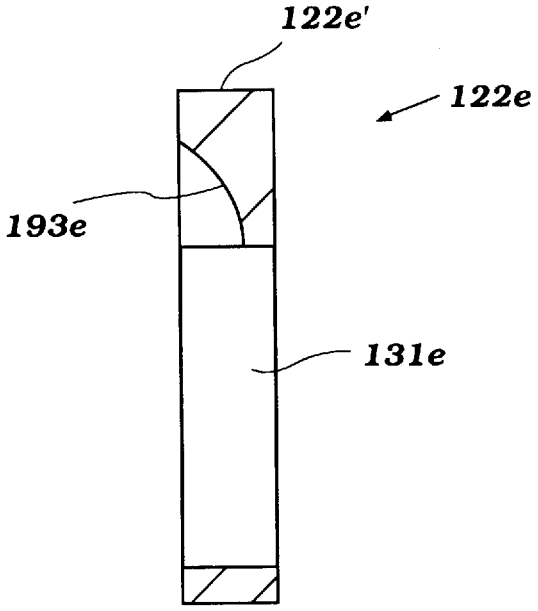
Figure 16:
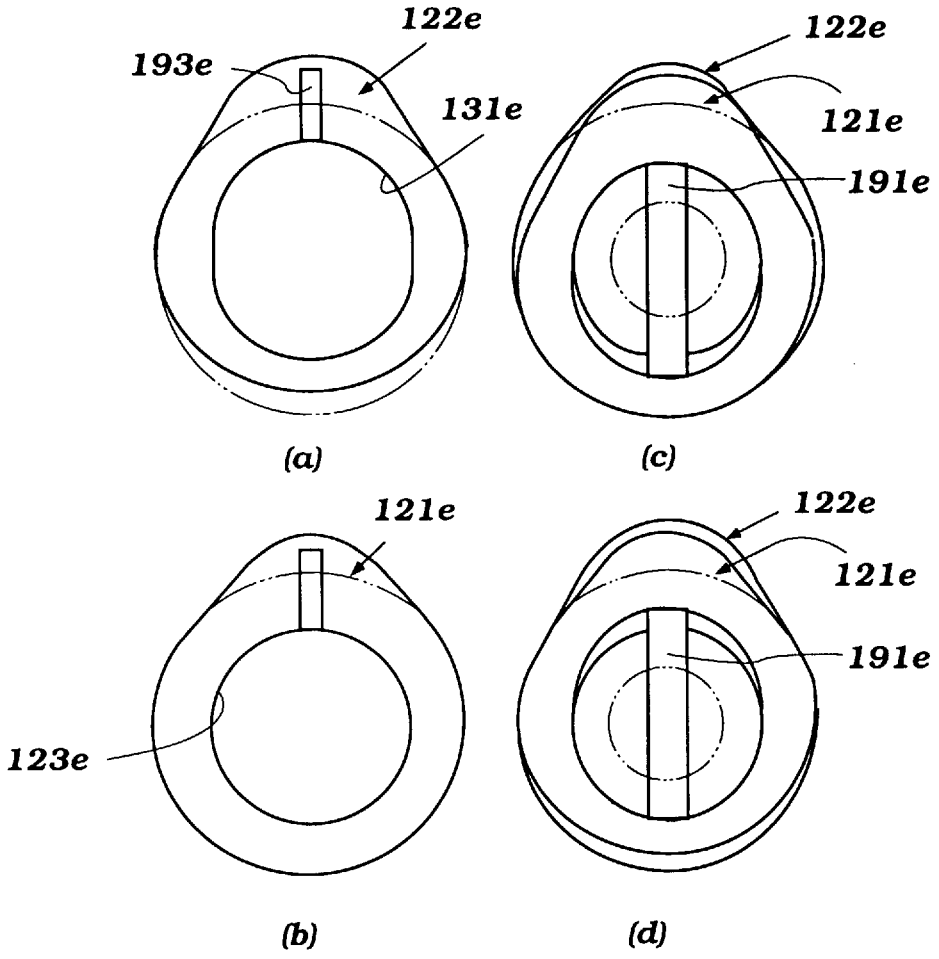
FIGS. 16*a–d* illustrate the cams of FIG. 13 at various operating positions.

FIGS. 14(*a*) and (*b*) illustrate the low speed cam 121*e* of this embodiment in more detail, and FIGS. 15(*a*) and (*b*) illustrate the high speed cam 122*e* of this embodiment in more detail. FIGS. 16(*a*) and (*b*) further illustrate these cams, and FIGS. 16(*c*) and (*d*) illustrate the positions of the cams at the low speed/low load and high speed/high load conditions, respectively.

Figure 17:
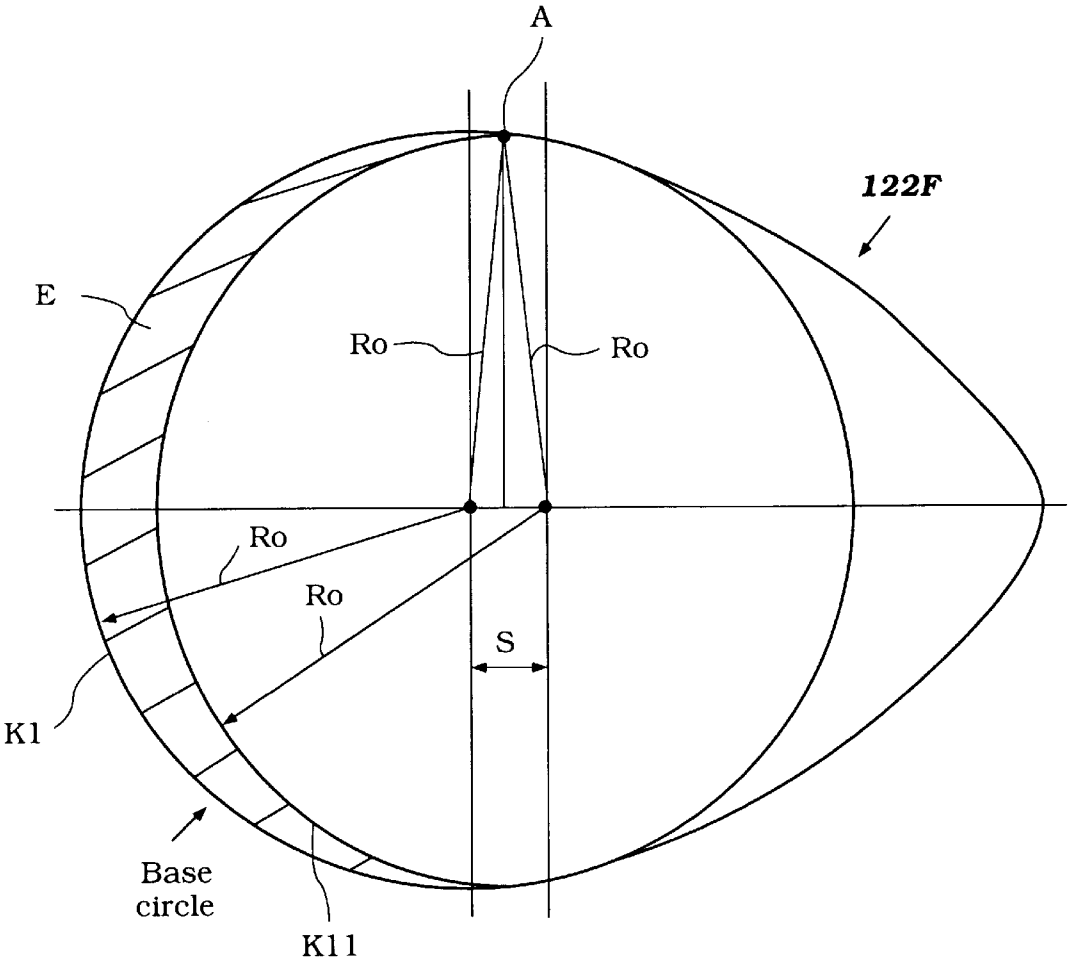
FIG. 17 illustrates a high speed cam profile for the variable cams of the present invention.

FIG. 17 illustrates a cam profile for a high speed cam 122*f* of the type which may be used with the embodiments of the present invention. The cam 122*f* has a base circle K1 with a radius Ro. When used with the variable cams described above, the cam 122*f* is shifted radially by an amount S, such that its base circle moves to a position K11 which preferably corresponds to the position of the base circle of the low speed cam.

Because of this shifting, the part of the cam 122*f* which is hatched as area "E" may be removed, since it has no effect on the operational characteristics of the cam. In this Figure, if the ramping portion of the cam begins before, or to the left of, point A then the ramp is effectively removed from use. This is illustrated in FIG. 19(*a*), wherein the ramping effect of the cam is effectively A-A'. This situation is disadvantageous, however, since the cam may hit the tappet or valve prematurely.

Figure 18:
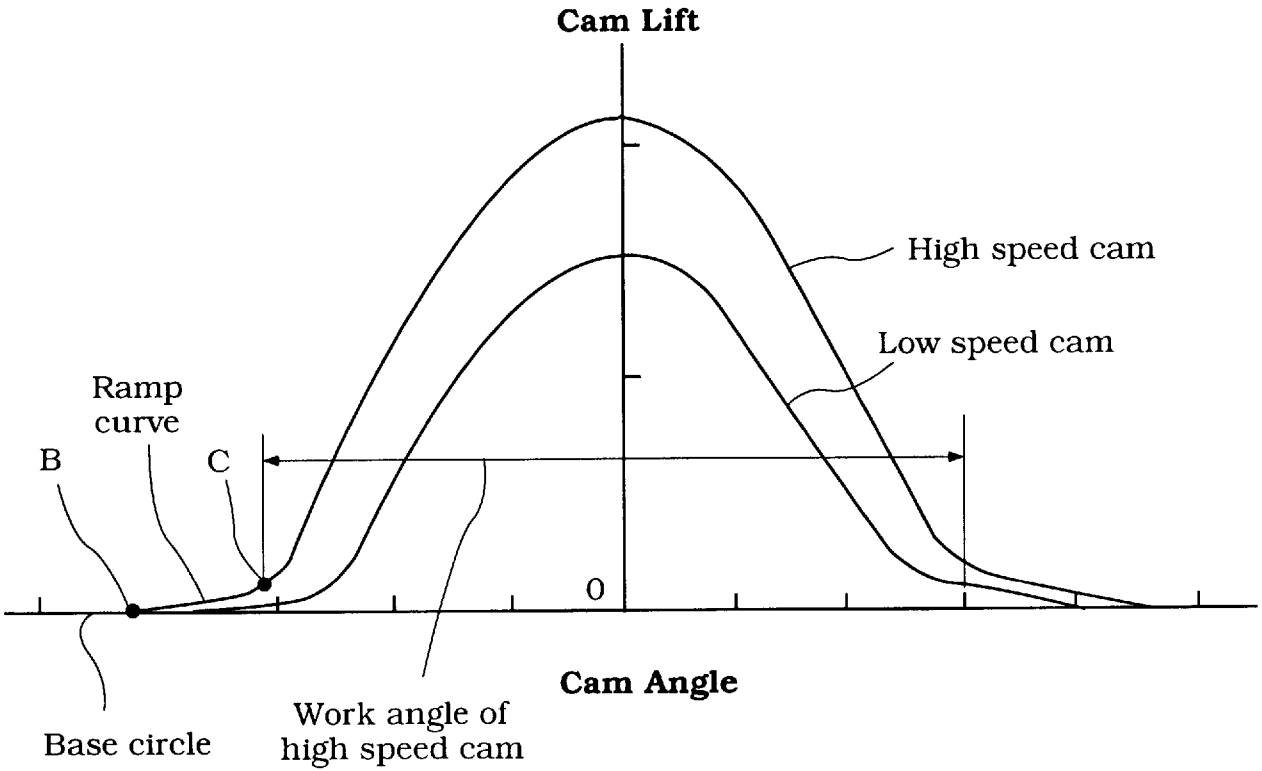
FIG. 18 is a graph illustrating cam lift versus cam angle for the variable cams of the present invention.
Figure 19A:
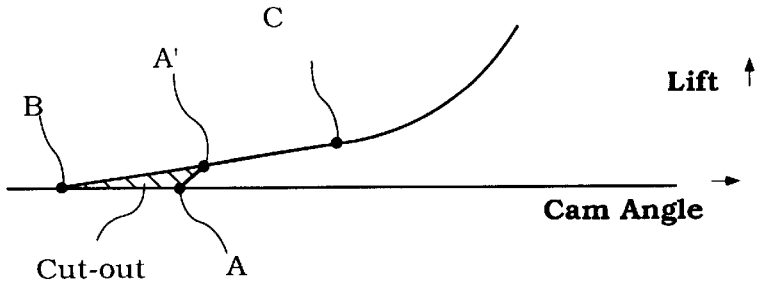
FIGS. 19*a–d* illustrate the effect of cam shape upon lift.
Figure 19B:
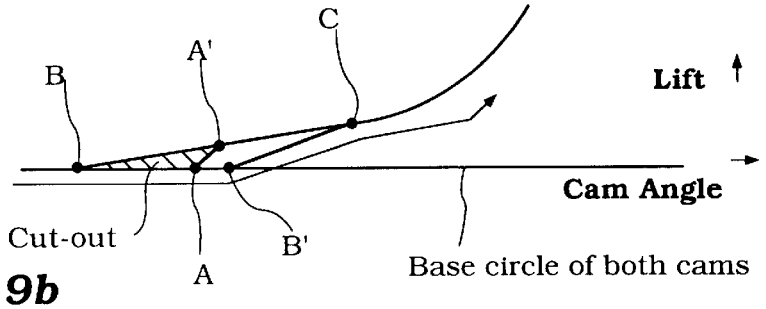
Figure 19C:
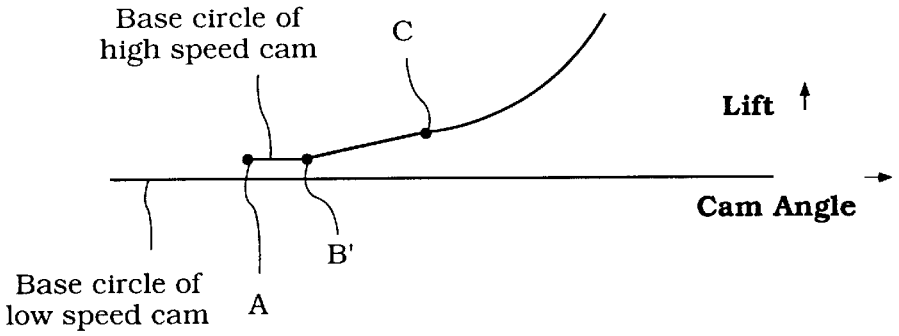
Figure 19D:
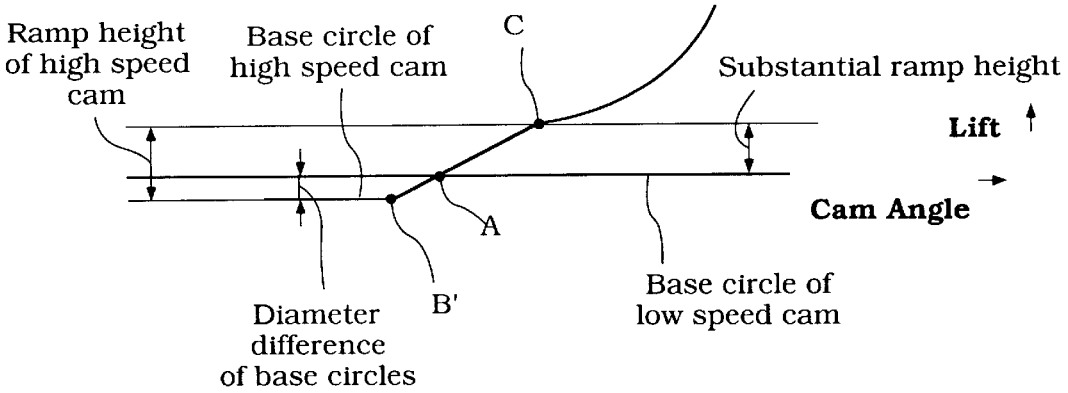

FIG. 18 is a graph illustrating the cam lift versus cam angle for the high and low speed cams of the variable cams of the present invention. In this Figure, the ramp curve of the high speed cam begins at a point B and stops at point C.

To avoid the above-described ramping problem but still provide the cam with a large working angle, the ramping portion may be started after point A, at a point B to the right thereof (with reference to FIG. 17) but increase at a much higher grade, as illustrated in FIG. 19(*b*). This arrangement provides smooth ramping, but as illustrated in FIG. 19(*c*), has the further disadvantage that the diameter of the base circle of the high speed cam must be larger than the diameter of the base circle of the low speed cam, preventing smooth transition of the tappet or lifter from the low speed to the high speed cam and vice versa.

FIG. 19(*d*) illustrates a solution to this problem in accordance with the prior art, in which the diameter of the base circle of the high speed cam is made less than that of the low speed cam, and ramping is provide between a point B' before point A, with the ramp continuing from B' past point A to a substantial ramp height C.

Figure 20:
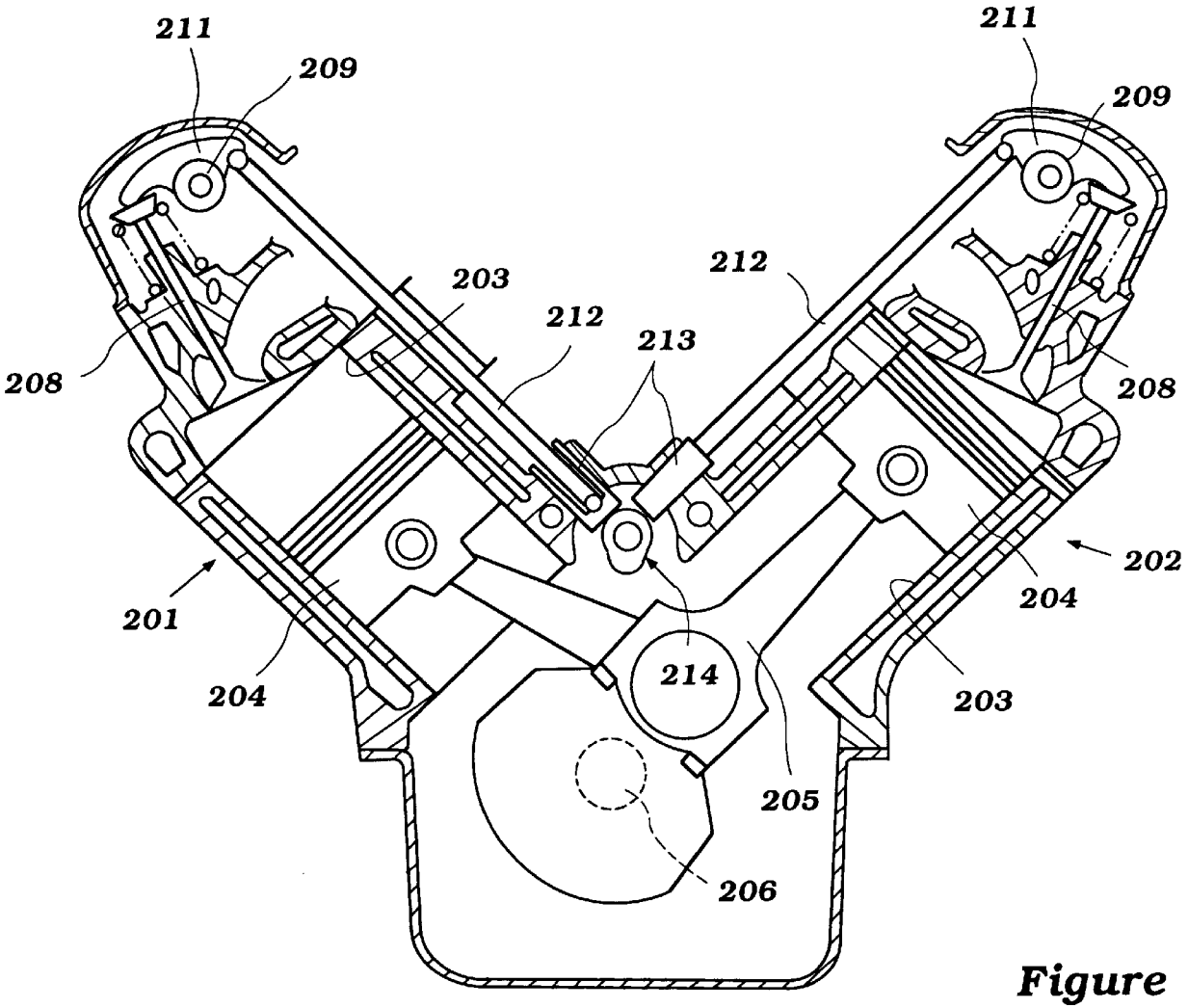
FIG. 20 is a longitudinal cross-sectional view taken through a V-type engine showing how the present invention can be practiced in conjunction with a pushrod type engine.

The invention as thus far described has been associated with an engine having an overhead camshaft in which the valves are directly actuated. It should be readily apparent, however, that this mechanism, since it is actuated in the cam mechanism itself, can be utilized with any type of valve-actuating mechanism. FIG. 20 shows such an embodiment as applied to a push rod-type actuated V-type engine, indicated generally by the reference numeral 201. The engine 201 has a cylinder block 202 in which cylinder bores 203 are formed. Pistons 204 reciprocate in these cylinder bores 203 and are connected by means of connecting rods 205 to a crankshaft 206.

Cylinder heads 207 are affixed to the cylinder banks of the cylinder block 202 and close the upper ends of the cylinder bores 203. Poppet-type valves 208 are mounted in the cylinder heads 207 and control the admission of a charge or discharge of the burnt charge to the combustion chambers.

Rocker arm shafts 209 are fixed in the cylinder heads 207 and journal rocker arms 211. One end of each rocker arm 211 is associated with the stem of a respective valve 208. The other end is engaged with a push rod 212. The push rods 212 extend downwardly and are engaged with tappets 213. The tappets 213 are, in turn, operated by a variable cam 214 in accordance with the present invention, including those of any of the embodiments illustrated and described above. The cam 214 is journalled at the base of the valley between the cylinder blocks and is driven by the crankshaft 206 through any suitable timing mechanism so as to rotate at one-half crankshaft speed.

Thus from the foregoing description it should be readily apparent that the described embodiment of the invention provide a very effective and simple mechanism for changing the lift of the valves in a reciprocating machine such as an engine while the engine is running.

Of course, the foregoing description is that of preferred embodiments of the invention, and various changes and modifications may be made without departing from the spirit and scope of the invention, as defined by the appended claims.

What is claimed is:

1. A valve-actuating variable cam for a reciprocating machine comprised of a camshaft journalled for rotation by said machine and driven in timed relationship with said machine, a first cam fixed upon said camshaft and rotatable with said camshaft, a second cam fixed for rotation with said camshaft and moveable relative to said first said cam in a direction radial to the axis of rotation of said camshaft, a shift rod slidably mounted within said cam shaft, said shift rod having a drive surface thereon driving a key element, said key element positioned within and engaging at least said second cam, means for moving said shift rod to a first position in which said first cam engages said valve, and to a second position in which said key pushes said second cam radially outwardly and said valve engages said second cam, wherein said means for moving includes a fluid passage extending through said camshaft and said shift rod, and a fluid port provided in said passage leading to a chamber adjacent a first end of said rod, wherein fluid flowing into said chamber moves said rod.

2. A valve-actuating mechanism as set forth in claim 1, wherein the second cam has a lobe and the lobe is shifted radially for effecting operation of the valve by the second cam lobe.

3. A valve-actuating mechanism as set forth in claim 2, wherein the base circle of the cams is such that the base circle of the second cam is smaller than the base circle of the first cam.

4. A valve-actuating mechanism as set forth in claim 1, including means for biasing said shift rod into said first position.

5. A valve-actuating mechanism as set forth in claim 1, wherein said means for moving comprises fluid acting upon a first end of said shift rod.

6. A valve-actuating mechanism as set forth in claim 1, wherein including a stop member fixed with respect to said shift rod, and where in said first position a first end of said shift rod engages said stop member and wherein a spring is mounted at an opposite end of said shift rod.

7. A valve-actuating mechanism as set forth in claim 1, wherein the first cam and the second cam are independently coupled for rotation with the same camshaft.

8. A valve-actuating mechanism as set forth in claim 1, wherein the camshaft is a tubular camshaft.

9. A value-actuating mechanism as set forth in claim 1, wherein said means further includes a fluid source and means for providing fluid from said source to said passage.

10. A valve-actuating mechanism as set forth in claim 1, wherein said drive surface of said shift rod has a first key-engaging area corresponding to said first position and a second key-engaging area corresponding to said second position.

11. A valve-actuating mechanism as set forth in claim 1, further including spring means biasing said key element into said first position.

12. A valve-actuating mechanism as set forth in claim 11, wherein said spring means comprises a spring-biased plunger element positioned in said second cam opposite said key element.

* * * * *

UNITED STATES PATENT AND TRADEMARK OFFICE

CERTIFICATE OF CORRECTION

PATENT NO. : 5,855,190
DATED : January 5, 1999
INVENTOR(S) : Nobuhiko Matsunaga

It is certified that error appears in the above-identified patent and that said Letters Patent is hereby corrected as shown below:

Column 14, claim 9,
Line 1, "A value-actuating" should be -- A valve-actuating --.

Signed and Sealed this

Twenty-fifth Day of December, 2001

*Attest:*

*Attesting Officer*

JAMES E. ROGAN
*Director of the United States Patent and Trademark Office*